US005326228A

United States Patent [19]

Armitage et al.

[11] Patent Number: 5,326,228

[45] Date of Patent: Jul. 5, 1994

[54] LIQUID EJECTION MIXING AND DISPENSING APPARATUS

[75] Inventors: David A. Armitage; John Peacock, both of Leicester, United Kingdom

[73] Assignee: Roussel-Uclaf, France

[21] Appl. No.: 937,910

[22] PCT Filed: Jan. 31, 1992

[86] PCT No.: PCT/GB92/00184

§ 371 Date: Dec. 1, 1992

§ 102(e) Date: Dec. 1, 1992

[87] PCT Pub. No.: WO92/14063

PCT Pub. Date: Aug. 20, 1992

[30] Foreign Application Priority Data

Feb. 1, 1991 [GB] United Kingdom ..... 91300829

[51] Int. Cl.[5] ..... B05B 7/26; F04F 5/44

[52] U.S. Cl. ..... 417/151; 417/158; 417/198; 239/310; 239/317; 239/346; 222/85

[58] Field of Search ..... 239/346, 310, 373, 340, 239/317; 417/151, 158, 198; 222/85, 325

[56] References Cited

U.S. PATENT DOCUMENTS

| | | | |
|---|---|---|---|
| 2,058,901 | 10/1936 | McPherson | 239/310 |
| 2,901,182 | 8/1959 | Cragg et al. | 239/373 |
| 3,165,114 | 1/1965 | Garrett | 239/317 |
| 3,421,738 | 1/1969 | Dulger | 239/317 |
| 3,784,116 | 1/1984 | Buckman et al. | 417/198 |
| 4,099,672 | 7/1978 | Sheahan et al. | 239/317 |
| 4,200,206 | 4/1980 | Chase et al. | 239/317 |
| 4,247,531 | 1/1981 | Hicks | 239/310 |
| 5,020,689 | 6/1991 | Eitner, Jr. et al. | 222/1 |
| 5,085,278 | 2/1992 | Keltner | 169/15 |
| 5,150,822 | 9/1992 | Eitner, Jr. et al. | 222/145 |
| 5,213,264 | 5/1993 | Styne | 222/85 |

FOREIGN PATENT DOCUMENTS

| | | | |
|---|---|---|---|
| 3120397 | 12/1982 | Fed. Rep. of Germany | 417/151 |
| 117399 | 7/1983 | Japan | 417/151 |
| 8911219 | 11/1989 | PCT Int'l Appl. | 239/310 |
| 1125415 | 11/1984 | U.S.S.R. | 417/151 |
| 1592738 | 7/1981 | United Kingdom | 239/373 |

*Primary Examiner*—Richard A. Bertsch
*Assistant Examiner*—Roland G. McAndrews
*Attorney, Agent, or Firm*—Bierman and Muserlian

[57] ABSTRACT

A method and apparatus for metering and dispensing an active ingredient, such as an insecticide, fumigant, fertilizer or room freshener. The active ingredient is placed in a container 6 and a pressurized propellant is subsequently introduced from a source 1 via conduits 3, 9. The propellant serves to absorb the active ingredient which is dispersed from the container via conduit 5 through a dispensing outlet 8 so that the active ingredient is dispersed in an airborne dispersion. In an ejector 4, a pressure differential is created across a propellant inlet port 4*a* which is sufficient to draw the active ingredient from the active ingredient container 6 but is less than the pressure differential required to cause a cooling effect in the mixing chamber 4 and is less than that pressure differential that gives rise to an erratic dispersion of the active ingredient from the dispensing outlet 8. The system is particularly suitable for the spraying of insecticides into large spaces such as warehouses and supermarkets.

3 Claims, 3 Drawing Sheets

LIQUID EJECTION MIXING AND DISPENSING APPARATUS

The present invention relates to a method and apparatus for the metering and dispensing of an active ingredient. The invention is applicable to the dispensing of atomised sprays and finds particular use in the spraying of insecticides especially where large spaces such as warehouses and supermarkets are to be sprayed. However, the invention is equally applicable to the dispensing of room fresheners, fertilizers and any other active ingredients which are capable of being borne in an atomised mist. The invention can also be used to charge portable cylinders of pressurised fumigant, etc for manual dispersal.

EP-A-425 300 (published 2 May 1991) describes an apparatus for dispensing an active ingredient wherein the active ingredient is placed in a container into which a pressurised propellant is introduced from a propellant source. Part of the propellant flows direct from the propellant source to a dispensing outlet by means of a bypass. The rest of the propellant enters the active ingredient container and expands to adopt a liquid phase and a gaseous phase. The liquid phase serves to absorb the active ingredient whereas the gaseous phase serves to propel the active ingredient out of the apparatus through a dispensing outlet where further expansion takes place and the active ingredient is dispersed in a fog or mist. Flow restrictors create a pressure differential between the active ingredient cylinder outlet and the bypass portion so as to facilitate absorption of the active ingredient into the bypass propellant stream. It has now been found that the correct choice of pressure differential and the inclusion of a specially designed mixing chamber can improve the efficiency of the system.

Accordingly, a first aspect of the present invention provides an ejector for mixing a stream of liquefied gaseous propellant and a liquid stream containing active ingredient, the ejector comprising: a mixing chamber; a first ejector conduit for supplying the propellant, the first conduit opening into the mixing chamber via a main jet; a second conduit for supplying the active ingredient to the mixing chamber; an outlet port opening out of the chamber and located opposite the main jet; and a third conduit connecting the exit port to a dispensing outlet, the third conduit flaring from the outlet port to have a diameter larger than that of the outlet port.

A second aspect of the invention provides an apparatus for mixing an active ingredient and a liquefied gaseous propellant, comprising a concentrate container for the active ingredient, an ejector comprising an inlet jet for propellant and a mixing chamber, a first conduit connecting the ejector inlet jet to a source of propellant and a second conduit connecting the concentrate container to the mixing chamber, a third conduit connecting the mixing chamber to a dispensing outlet, and a fourth conduit connecting the first conduit to the concentrate container, characterised in that a means is provided for creating a pressure differential between the fluid in the portion of the first conduit opening into the mixing chamber and the fluid in the mixing chamber, the said pressure differential being (i) sufficient to draw substantially all the active ingredient from the concentrate container, (ii) less than that required to cause a cooling effect in the mixing chamber and (iii) less than that which would give rise to an erratic dispersion of the active ingredient from the dispensing outlet.

An "erratic" dispersion of mixture is one in which the mixture is delivered in a pulsing or non-uniform fashion. This has been found to cause icing up of the outlet nozzles, followed by the ice breaking off, a sudden rush of mixture, more icing up and so on.

The 'cooling effect' in the mixing chamber results from the pressure differential between the propellant input stream and the mixing chamber. The actual temperature drop, for a given pressure differential, depends on the nature of the propellant and active ingredient. When used herein, the term 'cooling effect' means a temperature drop of more than 15° C. For example, when the liquid propellant is liquid carbon dioxide the temperature drop is suitably less than 10° C. and preferably less than 5° C.

Suitably, the means for creating the pressure differential between the propellant and the mixing chamber is a jet (termed hereinafter the "main jet") at the junction of the mixing chamber and the first conduit. In its simplest form, the jet is achieved by a reduction in the diameter of the first conduit where it joins the mixing chamber.

The size of the jet will be chosen to produce sufficient pressure drop to lift the entire contents of the active ingredient container, against gravity, through a distance of (preferably) at least 3.0 m, although it may be satisfactory to lift the concentrate through only 1.0 m or only 0.3 m. A small orifice creates a greater pressure drop than a large orifice. The size of the jet employed in the ejector will also be chosen by reference to the rate of fluid flow through the dispensing outlet, which outlet, enabling the active ingredient in propellant to be dispersed in the atmosphere, may be in the form of one or a number of individual nozzles. As the said flow decreases, the pressure drop across the jet increases resulting in icing of the mixing chamber and poor spray characteristics. We have found that the optimum size of jet is indicated by the formula:

$$d = 0.6\left(\sqrt[4]{F/6}\right)$$

where d is the jet diameter in millimeters and F is the rate of outflow through the outlet (i.e. the total of all the nozzles), in grams/second. For the avoidance of doubt, in the case of poor printing or copying of the above formula, it should be noted that d is three fifths of the fourth root of one sixth of F.

Satisfactory operation has been found when the said pressure differential is between 1 and 5 atmospheres ($1.01\times10^2-5.05\times10^2$ kPa). Typically the said pressure differential is about 2 atmospheres ($2.02\times10^2$ kPa), for example 1.8 to 2.2 atmospheres (1.82 to $2.22\times10^2$ kPa). Preferably, the pressure drop is substantially continuous, in other words it persists throughout the period of operation of the apparatus.

At the end of the operation, however, when the pressure of the $CO_2$ supply falls to a level at which the $CO_2$, at least after passing through the jet, is gaseous, the pressure drop across the jet will rise to about 3.0, 4.0 or 5.0 bars (300, 400 or 500 $kNm^{-2}$). This has the beneficial effect of completely exhausting the concentrate container which not only ensures that the intended dose of active ingredient is delivered but also cleans the concentrate container and makes it more safely disposable or returnable.

In a preferred embodiment the ejector and at least the beginning of the second and fourth conduits are arranged in a single assembly mixing unit.

Preferably the active ingredient container is positioned below the mixing chamber so that it is entirely the pressure differential which draws the active ingredient out of the active ingredient container and discharge takes place only when propellant is flowing. If the active ingredient container is not so positioned then a valve system is incorporated in the system to prevent active ingredient being siphoned into the mixing head. By "below", we mean at a lower level, but not necessarily underneath.

The propellant is a liquefied gaseous propellant. Preferably the propellant is liquid carbon dioxide but other propellants such as butane or propane/butane mixes can be used, particularly in open spaces where there is no risk of fire from such gases being confined. At least when the propellant is liquid $CO_2$, we have found that performance is optimal if the liquid $CO_2$ is supplied to the main jet at about 500–1500 psi (3450–10340 $kNm^{-2}$) depending on the temperature (typically 0°–40° C.) and if the pressure at the each outlet nozzle is as close as possible to the pressure of the $CO_2$ supply. As a practical matter, however, it is acceptable if the pressure drop between the $CO_2$ source and the outlet nozzle(s) is about 40–70 psi (275–480 $kNm^{-2}$), for example about 50–60 psi (345–415 $kNm^{-2}$). A pressure drop of 0.5–5.0 bar (50–500 $kNm^{-2}$), preferably 1.0 to 3.0 and most preferably about 2.0 bar (200 $kNm^{-2}$) is optimal at the main jet and thus the remaining pressure drop occurs in the third conduit. The third conduit typically consists of a series of conduits branching at successive T-junctions into successively narrower conduits. Poiseuille's Formula may be used to calculate the pressure drop in each conduit:

$$\Delta\rho = 896\eta GL/22\rho b^4$$

where $\Delta\rho$ is pressure drop in bars, $\eta$ is the viscosity in $Nsm^{-2}$, G is the mass flow in $kgs^{-1}$, L is the tube length in meters, $\rho$ is the density in $kgm^{-3}$ and b is the bore diameter in meters. In the formula above, the product of $\eta$, G, L and 896 is divided by the product of 22, $\rho$(rho) and the fourth power of b. By choosing the lengths and diameters of the conduits appropriately, the desired overall pressure drop between the mixing chamber and the outlet nozzles can be achieved and an excessive pressure drop along each individual conduit may be avoided since otherwise an undesirable level of cooling occurs, leading to icing up on the outside of the conduit. A pressure drop at each nozzle of about 500–1000 psi (3450–6900 $kNm^{-2}$), preferably 700–900 psi (4830–6200 $kNm^{-2}$) and more preferably about 800 psi (5500 $kNm^{-2}$) is optimal.

The active ingredient is in liquid form. The choice of active ingredient will depend upon the function to be performed and, consequently, a number of compounds may be used, including but not limited to repellants, antibacterials, fungicides, germicides, deodorants, antivirals, biologicals, ripening agents, growth regulators such as methoprene, hydroprene, dimilin and fenoxycarb and antisprouting compounds. The preferred active ingredient chemicals of this invention are natural pyrethrum and synthetic pyrethroids. Pyrethrum contains pyrethrins, botanical insecticides the active constituents of which are pyrethrins I and II and jasmolin I and II collectively known as "pyrethrins". The synthetic pyrethroids include allethrin, bifenthrin, bioresmethrin, cyfluthrin, cyhalothrin, cypermethrin, fenothrin, deltamethrin, esbiothrin, enothrin, fenvalerate, fluvalinate, lambda cyhalothrin, permethrin, resmethrin, tetramethrin and tralomethrin.

Many different concentrations of active ingredient chemicals in the final mixture are possible and are best arrived at by altering the concentration of active ingredient in the concentrate, rather than by altering the ratio of concentrate to propellant. We have found that a proportion of about 9.0–15.0% concentrate (especially if based on petroleum distillate) in the propellant (especially if $CO_2$) is suitable, preferably about 12%. For example a mixture of 0.5% pyrethrins, 4.0% piperonyl butoxide, 7.9% petroleum distillate and 87.6% liquid carbon dioxide, may be delivered. This mixture is recommended at the following dose (use) rates:

| | | |
|---|---|---|
| 1. | Flying Insects | 8 g per 1,000 cubic feet (28.32 $m^3$) |
| 2. | Crawling Insects | 16 g per 1,000 cubic feet (28.32 $m^3$) |
| 3. | Saw Toothed Grain and Cigarette Beetles | 24 g per 1,000 cubic feet (28.32 $m^3$) at 2 hours of exposure |

Expressed as delivery of active ingredient, the same delivery doses are:

| | | |
|---|---|---|
| 1. | Flying Insects | 0.04 g AI/1,000 $ft^3$ (28.32 $m^3$) |
| 2. | Crawling Insects | 0.08 g AI/1,000 $ft^3$ (28.32 $m^3$) |
| 3. | Saw Toothed Grain and Cigarette Beetle | 0.12 g AI/1,000 $ft^3$ (28.32 $m^3$) |

The pressures, viscosities and other parameters discussed above lead to the delivery of a fine fog of droplets of about 7 $\mu$m mean diameter.

For a delivery through a 32–64 nozzle system (each nozzle delivering 6 $gs^{-1}$) a concentrate volume of about 5.0–10.0 liters (4.0–8.0 kg) is generally suitable and about 30.0–80.0 kg of liquid $CO_2$ is enough to deliver this volume.

It has been found to be advantageous, particularly with the ejector dimensions and pressure parameters referred to above, for the viscosity of the active ingredient concentrate to be from 0.1 to 20 mPas (milliPascal seconds) as determined in the ASTM D445 test, preferably 0.5–10.0 mPas and more preferably about 1.5–3.0 mPas. A typical viscosity is about 2.17 mPas.

A further aspect of the invention provides a container for a liquid concentrate of an active ingredient, the container having a connecting top piece comprising a first bore; a second bore; a transverse bore extending between the first and second bores and opening into them; a slidable plug located in the transverse bore between the first and second bores, the slidable plug being urged towards one said bore but being prevented from entering said bore by a blocking plug; a first sealed conduit opening into the container adjacent the top thereof; and a second sealed conduit opening into the conduit adjacent the bottom thereof; the arrangement being such that a pin may be inserted into the bore which accommodates the blocking plug to dislodge the blocking plug and such that subsequent removal of the pin allows the slidable plug to enter the said bore and thereby prevent readmission of the pin.

In order that the invention may be more clearly understood, preferred embodiments will now be described with reference to the accompanying drawings in which.

EXAMPLE 1

Figure 1:
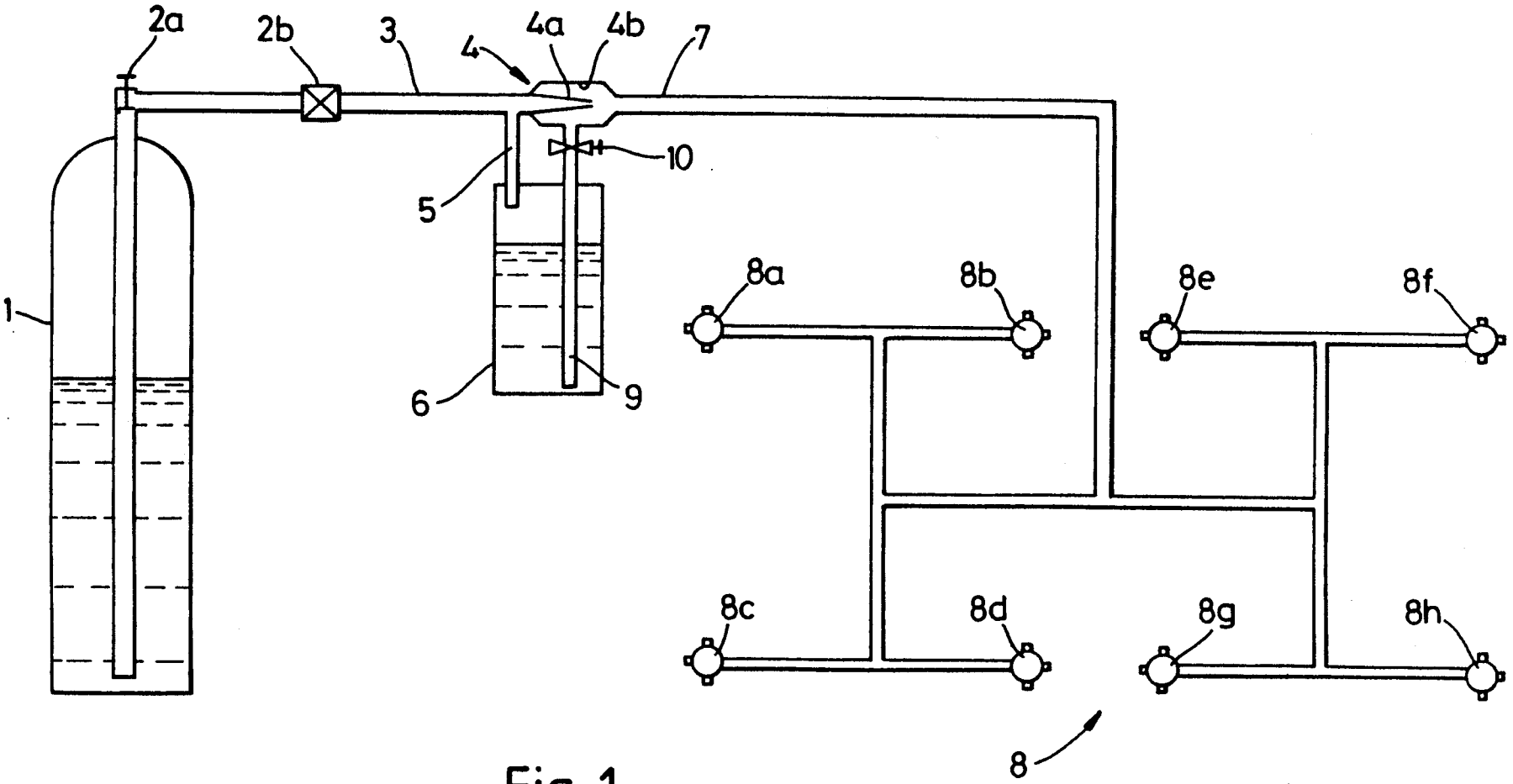
FIG. 1 is a schematic representation of a simplified system embodying the concept of the invention.

FIG. 1 shows a simple arrangement incorporating a source of propellant 1 which is most conveniently supplied in a cylinder but may, if a large volume is required, be a plurality of cylinders interconnected by a manifold. The propellant source 1 is connected via valves 2*a* and *b* in a first conduit 3 to a main jet 4*a* opening into a mixing chamber 4*b* in an ejector 4, and the propellant source is connected to a concentrate container 6 via a fourth conduit 5.

The propellant is, for example, liquid carbon dioxide and the active ingredient in the concentrate is a desired composition such as listed in the foregoing paragraphs of this specification. This example will be described in connection with the desired dispersal of the active ingredient in the amount required to fumigate, or otherwise treat, an enclosure of known measured volume. According to the known volume to be fumigated, a calculated amount of active ingredient is placed in the active ingredient container 6.

In order to commence dispensing, the valves 2*a* and *b* are turned to connect the propellant source 1 with the concentrate container 6. The propellant, in this case liquid carbon dioxide, is under pressure (approximately 840 psi, 5782 kPa) and flows through the first conduit 3 whereupon part of the flow passes through the jet 4*a* in the ejector 4 and part of the flow enters the concentrate cylinder 6 via the first 3 and fourth 5 conduits. Upon entering the concentrate container, the liquid carbon dioxide can act as a solvent to absorb the active ingredient in the concentrate cylinder 6.

The pressure of liquid carbon dioxide from the propellant source 1 is sufficient to prevent any backflow of absorbed active ingredient from the concentrate container 6 to the propellant source 1 and consequently it is not necessary to manipulate the values 2*a* and *b* further. The pressure in the concentrate container causes the combination of propellant and active ingredient therein to flow through the second conduit 9 into the mixing chamber.

The mixing chamber 4 is in communication with the dispensing outlet 8 through a third conduit 7, and therefore the mixing chamber (and active ingredient chamber) are effectively vented to atmosphere through the dispensing outlet 8 which, in this embodiment, consists of a plurality of nozzle clusters 8*a*–8*h*. Each cluster has four individual nozzles. Upon exiting through the dispensing outlet 8 the liquid carbon dioxide expands to form an airborne dispersion of particles of active ingredient.

This state will continue until all of the active ingredient which had previously been placed in the active ingredient container 6 is discharged. At this point the system can be closed down by isolating the propellant source 1 by valve 2*a* and the active ingredient container can be replaced or recharged with active ingredient when the system falls to atmospheric pressure.

From the foregoing description of the embodiment shown in FIG. 1 of the drawings, it will be appreciated that a metered amount of active ingredient can be discharged and, consequently, neither more nor less active ingredient need be discharged than is necessary for the desired purpose. The system is extremely simple in nature in that the valves are the only moving parts, and the system requires only a source of liquid carbon dioxide to act as a propellant, a container to receive the calculated charge of active ingredient, and conduits interconnecting the component parts and leading to a dispensing outlet. The conduits are preferably flexible hoses with quick disconnect attachments at their ends not only to permit convenient and rapid assembly and dismantling of the system but also to facilitate replacement of spent cylinders and containers. Greater control of the release of the contents of the active ingredient cylinder can be provided by including a metering means 10 in the second conduit 9.

Figure 2:
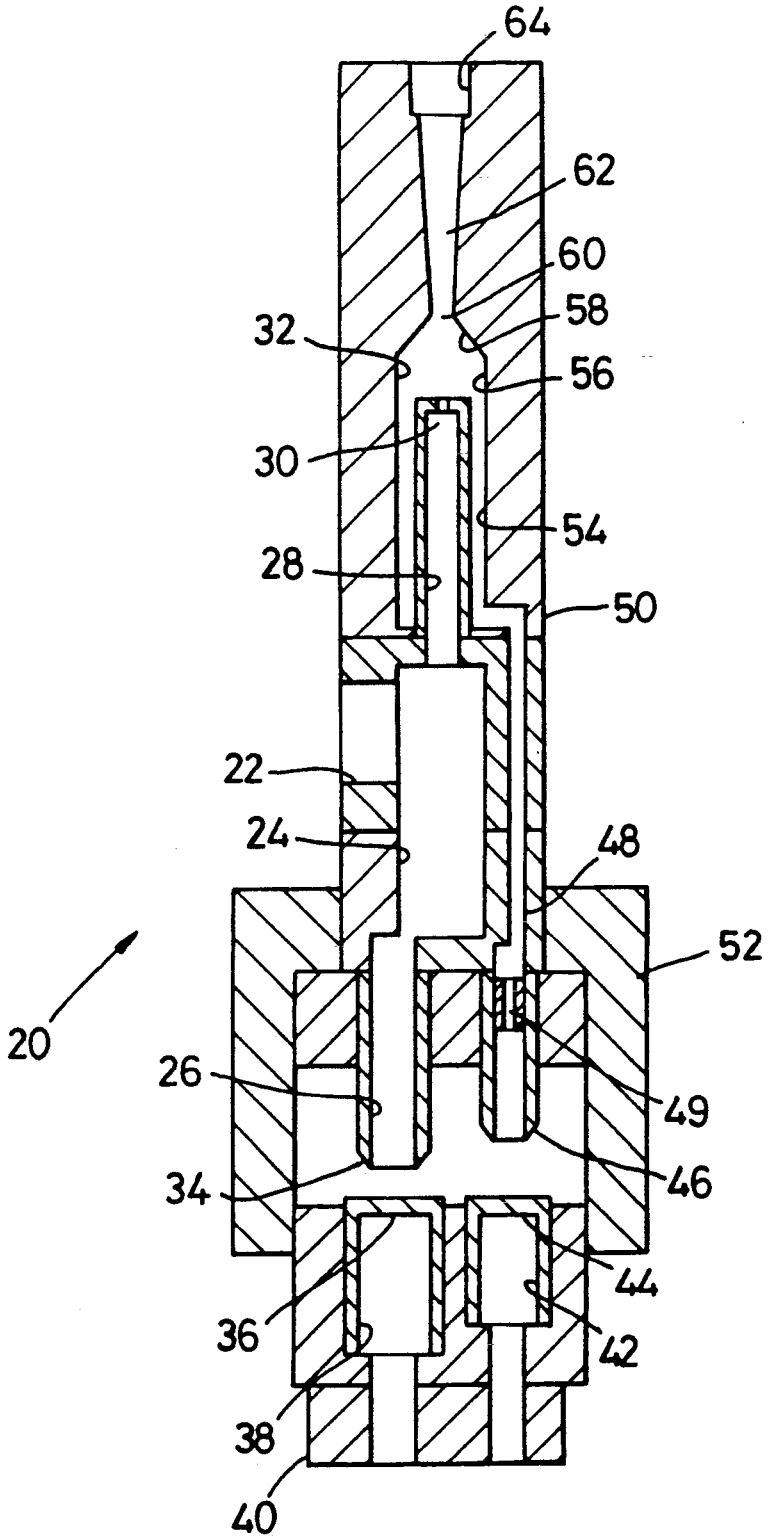
FIG. 2 is a more detailed longitudinal sectional view of an ejector and part of the concentrate container suitable for use in the system of FIG. 1.

In the preceding embodiment, the mixing chamber and adjoining portions of conduits connected thereto are shown located external to the active ingredient container. In an alternative arrangement (such as is shown in FIG. 2) the mixing chamber and adjoining portions of the first, second, third and fourth conduits are located in a single assembly 'mixing' head.

In the preceding embodiments, absorbed active ingredient has been described as being discharged from a dispensing outlet. It will be appreciated that if a warehouse or factory is to be fumigated, the discharge nozzle is most likely to take the form of an overhead sprinkler system from which the active ingredient can be uniformly dispersed throughout the contained volume. Thus, dispensing outlet 8 can consist of 32 or 64 individual nozzles, for example.

The system may be provided with a dosing container connected to the first conduit 3 by a 3-way connector such that a measured dose of propellant may be used, drawn from a large supply of propellant capable of delivering several such doses. Non-return valves and in-line filters may be included in the propellant conduits as needed.

EXAMPLE 2

FIG. 2 shows a development of the ejector of the simple system of FIG. 1. The ejector is shown generally at 20 and comprises an inlet 22 for liquid $CO_2$ propellant, opening into a diversion chamber 24 which splits the flow of $CO_2$ between a $CO_2$-to-concentrate conduit 26 and a $CO_2$-to-jet conduit 28 terminating in a main jet 30 opening into a mixing chamber 32. The $CO_2$-to-concentrate conduit 26 is equivalent to part of the "fourth conduit" in the FIG. 1 embodiment. The $CO_2$-to-concentrate conduit 26 terminates in a sharp orifice 34 adapted to penetrate a seal 36 across the inlet conduit 38 of a concentrate container 40, only the top of which is shown in FIG. 2. The said inlet conduit 38 constitutes the rest of the "fourth conduit" of FIG. 1. The concentrate container 40 is also provided with an outlet conduit 42, similarly provided with a seal 44, adapted to be penetrated by the sharp end 46 of a mixture conduit 48, which leads via a metering jet 49 and an annular region 54 surrounding the $CO_2$-to-jet conduit 28, to the mixing chamber 32. The outlet conduit 42 and mixture conduit 48 constitute the "second conduit" in FIG. 1. The said $CO_2$ inlet 22, diversion chamber 24, conduits 26, 28 and 48 and mixing chamber are all provided as parts of a so-called mixing head which may be screwed tightly with a screw ring 52 onto the concentrate container 40 in order for the sharpened orifices 34, 46 to penetrate their respective seals 36, 44.

The mixing chamber 32 is constituted by a generally cylindrical portion 56 adjacent the jet 30 and a funnel-shaped portion 58 centred around an outlet port 60. The outlet port 60 opens into a flared recovery zone 62 which terminates in a female connector portion 64 adapted to receive a corresponding male connector portion (not shown) on the end of a conduit leading to the outlet nozzles, i.e. the "third conduit" of FIG. 1.

Figure 3:
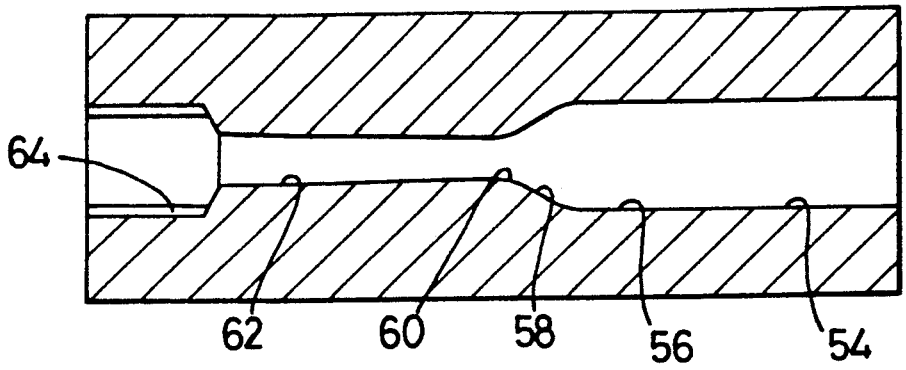
FIG. 3 is an enlarged sectional view of the mixing chamber and recovery zone of the ejector of FIG. 2.

FIG. 3 shows the mixing chamber and recovery zone in more detail. The whole length of the article shown is 95 mm. The annular region 54 of the mixture conduit 48 and the cylindrical portion 56 of the mixing chamber together extend for 36 mm and each have a diameter of 13 mm. The annular portion 54 of the mixture conduit 48 is included for manufacturing convenience only and serves only to deliver the initial concentrate/$CO_2$ mixture to the mixing chamber. It is just as effective, although harder to make, for the said mixture to be delivered directly to the mixing chamber via a simple (non-annular) conduit. The funnel-shaped portion extends for an axial length of about 10 mm and has a funnel angle of about 45° to the axis of the article, the funnel portion 58 being smoothly radiused to join with the cylindrical portion 56 and smoothly radiused to merge into the outlet port 60, which has a diameter of 4.2 mm. The size of the outlet port is not especially critical and may be increased to, say, 5.0 mm if a large flow (for example for a 64 nozzle system) is needed. The recovery zone 62 extends axially for 33 mm, the first 3.0 mm of which has a parallel bore and the next 30 mm of which flares at an included angle of 5° (i.e. an angle of 2.5° to the centre line or axis) such that it terminates in a diameter of 7.0 mm. The length of the parallel bore section of the recovery zone should be as short as possible and preferably does not exceed 5.0 mm. A length of no more than 3.0 mm, 2.0 mm or 1.0 mm is preferred. Expressed in terms of proportions, the length of the parallel bore section preferably does not exceed 15% of the total length of the recovery zone, and more preferably is no more than 10%, 5%, 2or 1% thereof. All of these are regarded as constituting a flared recovery zone immediately adjacent the outlet port.

When the male connector of the outlet conduit is in place in the female connector portion 64, the internal bore of the conduit is aligned with the internal bore of the recovery zone 62 so that there is no sudden step. A smooth flow of the stream is important. The gap between the jet 30 and the outlet port 60 is preferably 5–10 mm since the shape of the jet is then less critical. A gap of less than 5 mm may be usable with a smaller jet. A gap of more than 10 mm does not cause efficient entrainment of the mixture by the $CO_2$.

In use, the mixing head 50 is screwed onto the concentrate container 40 as said, and a source of liquid $CO_2$ is connected to the $CO_2$ inlet 22. Some of the $CO_2$ passes into the concentrate container 40 and mixes with the concentrate therein. The remainder passes through the jet 30 into the mixing chamber 32 to create a pressure differential between the $CO_2$ supply and the chamber. This pressure drop draws the mixture of $CO_2$ and concentrate up from the concentrate container 40 through conduit 48 into the mixing chamber 32, whereupon it mixes with the $CO_2$ therein and leaves through the exit port 60.

The relatively long length of the $CO_2$-to-jet conduit 28 helps to eliminate turbulence and eddies therein, which in turn allows a more controlled and axially symmetrical flow path of mixture in the mixing chamber 32. A length of 36 mm is suitable. Greater lengths are also usable, although usually unnecessary. A length of less than 25 mm may be less satisfactory.

The rate of delivery of active ingredient can be controlled with the metering jet 49. Any suitable metering device may be used and it is set by reference to the flow rate and viscosity of the mixture passing through it. It has been found that the operation of the system, in terms of the efficient exhaustion of concentrate from the container 40 and delivery to the outlet nozzles, is affected by the setting of the metering jet 49 only if the rate of delivery through the nozzles is low, for example about 1.0–30.0 $gs^{-1}$ in total. Certainly, at deliveries of above about 180 $gs^{-1}$, the setting of the metering jet 49 is not critical for performance. The sharpened end 46 of the mixture conduit 48 may be made to be removable from the mixing head 50 together with the metering jet 49 so that the metering jet 49 may be replaced to suit different delivery systems.

For a lift of 0.3–0.5 m (from the concentrate level in concentrate container to the mixing chamber) and a viscosity typical of paraffin or diesel oil, an aperture of about 2 mm diameter (generally 1.5–2.5 mm) is satisfactory. For a less viscous concentrate, a diameter of 1.0–1.5 mm may be suitable and, for a more viscous concentrate, a diameter of 2.5–3.0 may be better.

Because of the pressure drop across the jet 30, some of the $CO_2$ evaporates to form a vapour or gas. The flared recovery zone 62 allows such vapour or gas to recondense and dissolve back into the $CO_2$/concentrate mixture such that, by the time the stream enters the conduit leading to the outlet nozzles, there is substantially no gas or vapour in the stream. It is extremely important for the stream at the end of the recovery zone to be substantially entirely liquid, since this cause the delivery of the mixture to and through the outlet nozzles to be smooth. An additional benefit of recondensing and redissolving the gaseous $CO_2$ into the liquid stream in the recovery zone is that the small amount of heat produced helps to counteract the cooling effect in the mixing chamber and thereby helps to prevent icing up.

Figure 4:
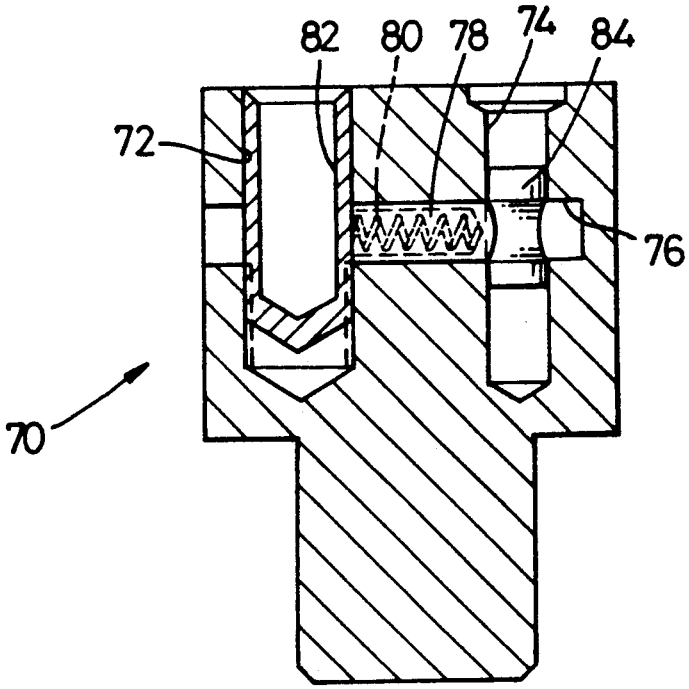
FIG. 4 is a vertical sectional view of the top of a concentrate container for attachment to the ejector of FIG. 2.

FIG. 4 shows a section through the top piece of the concentrate container 40 which, in FIG. 2, is shown only schematically. The top piece 70 has a first bore 72 adapted to receive a first pin (not shown) on the mixing head and a second bore 74 adapted to receive a second pin (also not shown) on the mixing head. The first and second pins are arranged as an orthogonal array with the sharpened ends 34, 36 of the $CO_2$-to-concentrate conduit 26 and the mixture conduit 48. A transverse bore 76 passes in through one side of the top piece 70 and through the first and second bores 72, 74 to terminate in a blind bore. A slidable plug 78 is located in the central part of the transverse bore 76, in other words between the first and second bores 72, 74. The plug 78 is provided with a bore which accommodates a coiled compression spring 80 which is held in place, under compression, by a hollow sleeve 82 which lines the first bore 72. The slidable plug 78 is prevented from being urged into the second bore 74 by a blocking plug 84 which has a waist portion to nest with the adjacent end of the slidable plug 78.

The concentrate container is supplied to the user with the appropriate charge of active ingredient already in the container and the seals 36, 44 (shown in FIG. 2 and discussed above) intact. The seals may be colour-coded to help the user identify which bore is which. In addition, as is clear from FIGS. 2 and 3, one bore 74 is narrower than the other 72 and the pins on the mixing head are similarly sized so that the mixing head and the concentrate container cannot be connected wrongly.

To use the apparatus, the user engages the mixing head with the concentrate container to break the seals. In doing so, the blocking plug is pushed down into the second bore 74 of the concentrate container top piece by the second pin on the mixing head and the slidable plug 78 is kept in place only by the sharpened end 46 of the mixture conduit 48. When the mixing head is detached after use, the slidable plug 78 is urged into the second bore 74 by the spring 80 and will thereafter act to prevent re-engagement of a mixing head. This prevents the user from re-using the concentrate container. Instead, it is returned to the manufacturer for controlled refilling, which involves removing the sleeve 82 and re-setting the spring and plug arrangement as described above.

We claim:

1. An ejector for mixing a stream of liquified gaseous propellant and a liquid stream containing an active ingredient comprising an inlet 22 opening into a diversion chamber 24 to divide propellant flow between a propellant-to-concentrate conduit 26 and a propellant-to-jet conduit 28 terminating in a main jet 30 opening into a mixing chamber 32; propellant-to-concentrate conduit 26 terminates in a sharp orifice 34 to penetrate a seal 36 of an inlet conduit 38 of a liquid container 40 the liquid container having an outlet conduit 42 provided with a seal 44 to be penetrated by a sharp end 46 of a mixture conduit 48 connected by a metering jet 49 and an annular region 54 surrounding the propellant to jet conduit 28 to said mixing chamber 32, the mixing chamber 32 is comprised of a cylindrical portion 56 adjacent to jet 30 and a funnel shaped portion 58 centered about an outlet point 60 opening into a flared recovery zone 62 terminating in a female connector 64.

2. An ejector of claim 1 wherein the flared recovery zone 62 has an inclined angle of not more than 10°.

3. An ejector of claim 2 wherein the said angle is 3° to 5°.

* * * * *